United States Patent [19]

Ball

[11] Patent Number: 5,054,791

[45] Date of Patent: Oct. 8, 1991

[54] BACKGROUND SHIELD FOR SOCCER PRACTICE

[76] Inventor: Alan F. Ball, 2601 70th Ave. South, St. Petersburg, Fla. 33712

[21] Appl. No.: 666,904

[22] Filed: Mar. 11, 1991

[51] Int. Cl.[5] ..... A63B 69/00

[52] U.S. Cl. ..... 273/396; 273/26 A; 273/411

[58] Field of Search ..... 273/396, 397, 411, 26 A

[56] References Cited

U.S. PATENT DOCUMENTS

| | | | |
|---|---|---|---|
| 1,591,753 | 7/1926 | Flaugh | 273/26 A |
| 2,229,180 | 1/1941 | Larson | 273/411 X |
| 2,819,901 | 1/1958 | Matena | 273/26 A X |
| 4,072,295 | 2/1978 | Roberts | 273/26 A X |
| 4,286,786 | 9/1981 | Papadopoulos | 273/396 |
| 4,478,420 | 10/1984 | Sowards | 273/411 |
| 4,693,472 | 9/1987 | Newman et al. | 273/26 A X |
| 4,703,931 | 11/1987 | Steen | 273/26 A |
| 4,948,147 | 8/1990 | Pallanca | 273/411 X |

*Primary Examiner*—William H. Grieb

*Attorney, Agent, or Firm*—Walter J. Monacelli

[57] ABSTRACT

The shield device shown herein is one to aid in soccer practice. An individual player can practice kicking a soccer ball into the apparatus and have it bounced back in his general area. The lower area of the shield comprises a back panel and two side panels connected at an angle to the back panel. Each panel is made of a sufficiently rigid material, such as a thick plywood, to absorb the impact of the kicked soccer ball. Above the panels there is a netting, such as nylon netting to guard against and intercept errant flights of the ball.

8 Claims, 2 Drawing Sheets

BACKGROUND SHIELD FOR SOCCER PRACTICE

BACKGROUND OF THE INVENTION

1. Field of the Invention

This invention relates to a specifically designed background shield for soccer practice. More specifically this shield is designed to return the soccer ball back to the area from where the ball is kicked. Still more specifically, this background shield is related to a foldable and portable shield which may be transported and which is foldable for storage and for transportation.

2. State of the Prior Art

There are a number of patents describing various background shields for practicing various games. For example, U.S. Pat. Nos. 1,591,753 and 4,072,295 disclose foldable screens, backstops or batting cages in which a batter can swing at a thrown baseball without the danger of having the baseball hitting a catcher or a spectator. These are of primarily steel mesh or chain link fences.

U.S. Pat. No. 4,693,472 shows a portable background net made of nylon or other low extensible threads suitable for practicing tennis, cricket, baseball, etc.

U.S. Pat. No. 2,229,180 describes a game played against a vertical wall with an upper backwardly sloped section, which wall is apparently non-portable and against which a tennis ball, etc., is bounced against the wall. Each of the players has a catching device comprising a handle, a wire loop connected to the handle and an open-ended bag attached to the loop. One player bounces the ball to a designated area on the wall in a manner such that the bounced ball cannot be caught by an opposing player in his "bag".

None of these disclosed devices is designed for soccer practice, particularly one that will bounce the ball back to the player.

OBJECTIVES

It is an object of this invention to provide a background shield for soccer practice.

It is also an object of this invention to provide such a shield which will allow the ball to be bounced back toward the playing area.

It is also an object of this invention to provide an upper section of netting to protect against wild kicks.

It is also an object of this invention to provide such a background shield which is preferably portable.

Other objects will become obvious upon reading the detailed description of the invention as given hereinafter.

SUMMARY OF THE INVENTION

In accordance with the present invention, a background shield for soccer practice has been designed. This shield comprises a three-sided backdrop including a back panel and two side panels each connected to the back panel and positioned at angles of more than 90° with this back panel. Preferably these side panels are connected to the back panel by pivoting means such as hinges so that the said angles may be adjusted and so that the side panels may be closed flush with the back panel for storage and transportation. The back panel and each of the side panels is solid and of sufficient strength to withstand the impact of a kicked soccer ball. Above each said panel there is stretched a netting, preferably of nylon or other strong fiber, which can constrain errant kicks which elude the back panel. This netting can be of woven strands preferably of nylon to withstand the impact of a soccer ball. This netting is rigidly connected to the lower solid panels in such a manner that the impact of a soccer ball will not separate the netting. The netting is advantageously fastened to two outermost posts extending above the side panels and stretched tightly over but not fastened to two posts rising from the back panels. The posts, particularly the two posts to which the netting is attached should be removable from the supporting fixtures which are affixed to the side panels. Removal of the netting is advantageous when the three panels are to be folded for transportation or storage. The back panel has bracing supports on the backside thereof to keep the back panel from being knocked backward by the impact of a kicked soccer ball hitting the front of the panel. This brace means may also be detachable for storage and transportation.

BRIEF DESCRIPTION OF THE DRAWINGS

The description of the invention is facilitated by reference to the drawings.

DESCRIPTION OF THE PREFERRED EMBODIMENTS

Figure 1:
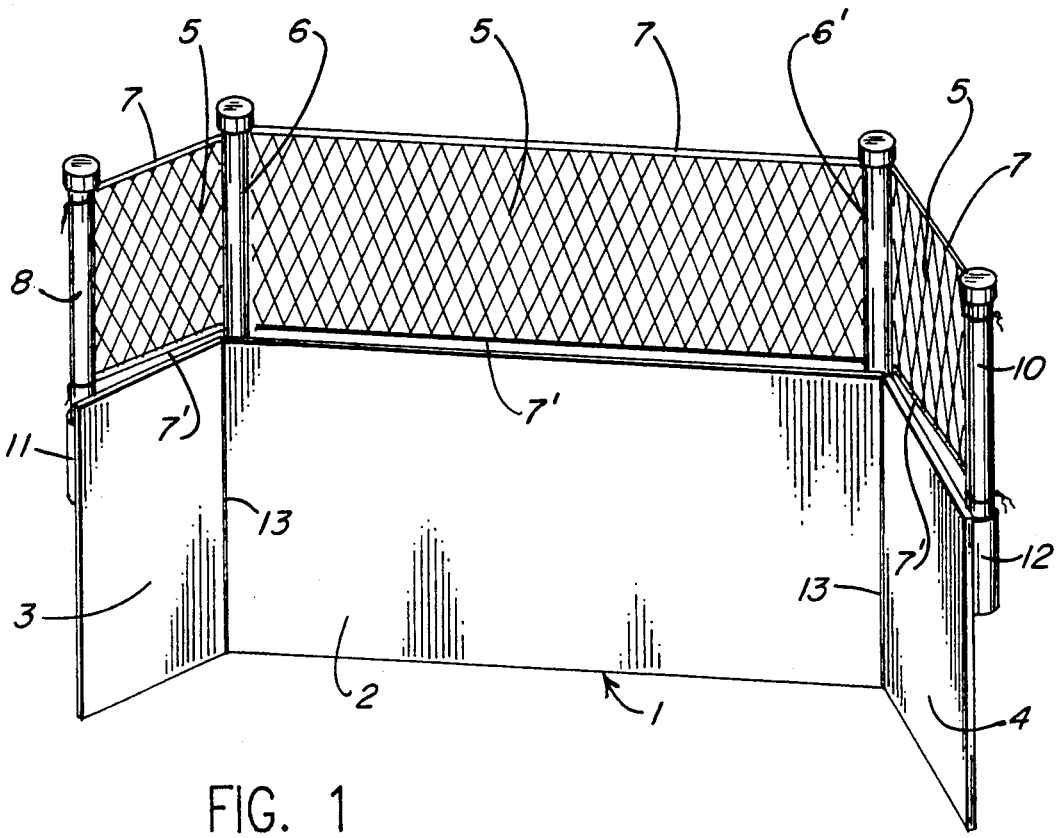
FIG. 1 is an elevational front view of a preferred modification of this invention.

In the preferred embodiment shown in FIG. 1, background shield 1 comprises back panel 2 and side panels 3 and 4. Netting 5 has upper edging 7 and lower edging 7' and is fastened to posts 8 and 10. Posts 8 and 10 have lower portions (not shown) which fit into openings in connectors 11 and 12 respectively and are pivotable on and supported by connectors 11 and 12. Netting 5 is stretched around middle posts 6 and 6' but is not fastened to these two middle posts. When it is desired to move or store the shield, posts 8 and 10 are lifted off of connectors 11 and 12 so that the netting may be folded and side panels 3 and 4 may be folded onto back panel 2.

Figure 2:
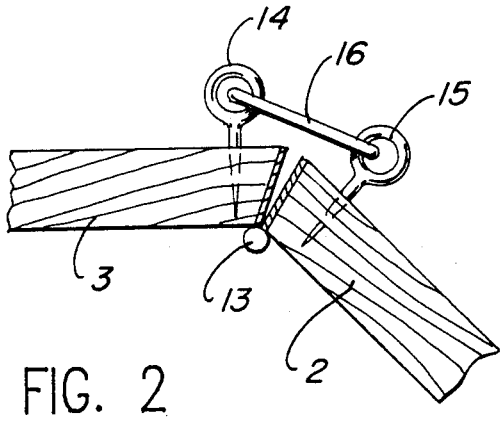
FIG. 2 is a top plan view of the juncture of two sections of the invention shown in FIG. 1.

FIG. 2 shows a hinge 13 by which panel 3 is pivotably connected to panel 2. Eyelets 14 and 15 are embedded in the respective panels. Connector 16 is looped through the eyelets 14 and 15 and serves to restrict the movement of panel 3 from the desired angle with panel 2. A disconnecting means (not shown) by which connector 16 may be separated from one of the eyelets is provided so that when desired panel 3 may be folded flat upon panel 2. Similar provisions are made with regard to the positioning of panel 4 with respect to panel 2.

Figure 3:
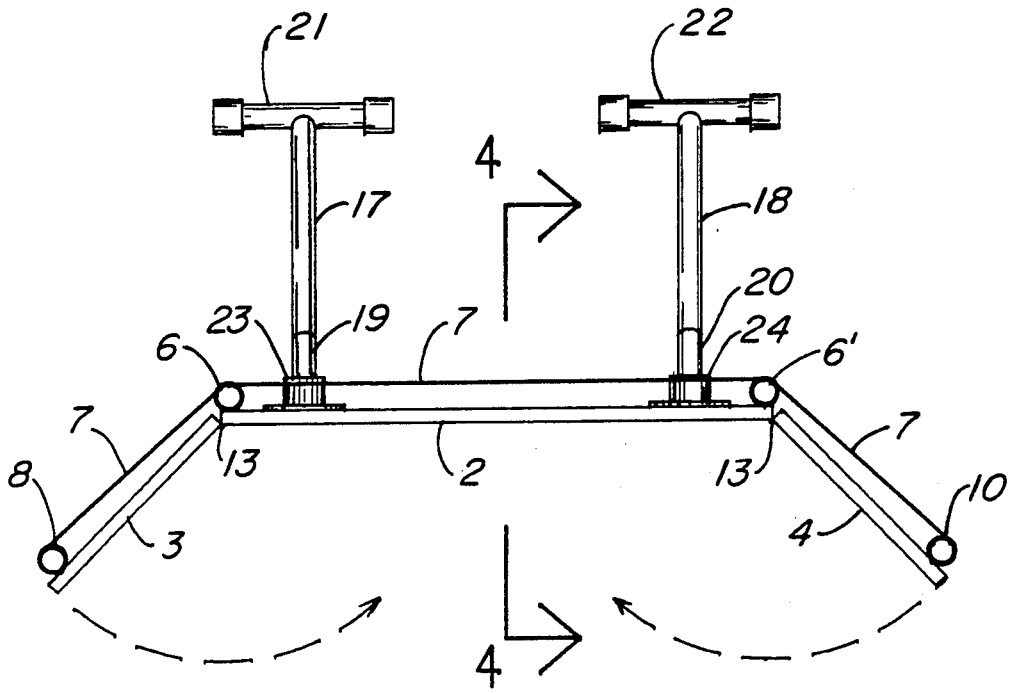
FIG. 3 is a top plan view of the preferred modification of FIG. 1.

The top plan view of FIG. 3 shows angular bracing supports 17 and 18 with horizontal braces 19 and 20. Ground braces 21 and 22 are connected to bracing supports 17 and 18. Brackets 23 and 24 are used to fasten horizontal braces 19 and 20 respectively to the back of panel 2.

Figure 4:
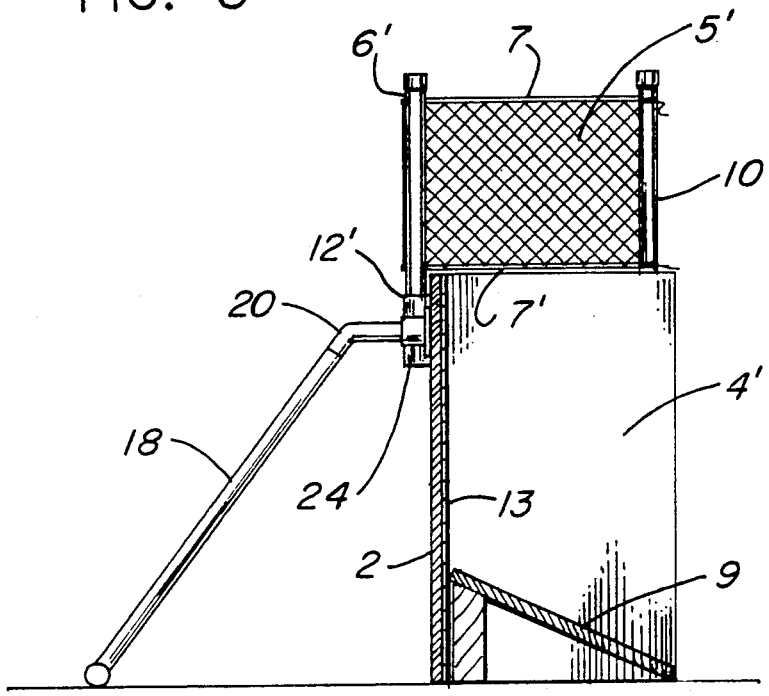
FIG. 4 is a cross-sectional side elevational view of the modification of FIG. 1 taken at line 4—4.

The partial cross-sectional view of FIG. 4 shows another view of the bracing structure described above for FIG. 3. FIG. 4 also shows in cross-section an optional device, namely, slanted panel 9 which will intercept a ball directed toward the lowest area of panel 2 and redirect it to a higher region of panel 2. This will mean that the ball is bounced back in the air instead on the adjacent ground area. This figure also shows how connector 12' is abutted to and rigidly affixed to panel 2 for support of post 6'. Similar arrangements apply for connectors 11 and 12 which receive and support posts 8 and 10.

While plywood has been indicated as suitable for use in the panels of the above device, other suitable materials may be used such as sheeting of wood, plastic, metal, etc., provided the material can withstand the impact shock of a kicked soccer ball. Moreover, other types of netting may be used in place of the nylon netting such as cotton cord, metal wire, etc., provided it has the strength to serve this purpose.

The dimensions of the panels and the netting can be varied to convenient sizes. A practical size for portability is 2 feet high and 4 feet wide for the back panel and 2 feet by 2 feet for the side panels. The relatively small size of the back panel also allows the player to practice accuracy in his kicking. The netting may be 1–3 feet high, preferably 1.5–2 feet, and long enough to reach from the third post to the fourth post as described herein with any additional amount needed for fastening.

While certain features of this invention have been described in detail with respect to various embodiments thereof, it will of course be apparent that other modifications can be made within the spirit and scope of this invention and it is not intended to limit the invention to the exact details shown except insofar as they are defined in the following claims.

The invention claimed is:

1. A background shield for soccer practice comprising:

(a) a back panel having a first and a second side opposite to each other, said panel being of a strong rigid material capable of withstanding the impact of a kicked soccer ball, said back panel being capable of being positioned in a vertical position with said first and second sides thereby being extended vertically;

(b) first and second side panels of a similar rigid material, said first side panel being hingedly connected to said first side of said back panel and said second side panel being hingedly connected to said second side of said back panel;

(c) first and second posts extending vertically upward from the back of said back panel, said first post being rigidly fixed to said back panel and adjacent to said first side of said back panel and said second post being rigidly fixed to said back panel and adjacent said second side of said back panel, said first and second posts extending a substantial distance above said back panel;

(d) a third post extending vertically upward from and rigidly fixed to said first side panel, the position of said third post being spaced from and parallel to that side of said first side panel which is hingedly connected to said back panel, said third post extending a substantial distance above said first side panel;

(e) a fourth post extending vertically upward from and rigidly fixed to said second side panel, the position of said fourth post being spaced from and parallel to that side of said second side panel which is hingedly connected to said back panel, said fourth post extending a substantial distance above said second side panel;

(f) a netting of strong cord having a sufficient length to reach from said third post, behind said first and second posts and to said fourth post, the height of said netting being sufficient to reach from the upper edge of said first side panel, said back panel and said second side panel vertically to a substantial height above said first side, back, and second side panels, said netting being at least temporarily affixed to said third post and to said fourth post; and (g) a bracing means capable of maintaining the back panel in upright position against the impact of a kicked soccer ball.

2. The background shield of claim 1 in which said third post is removably fixed to said first side panel.

3. The background shield of claim 1 in which said fourth post is removably fixed to said second side panel.

4. The background shield of claim 1 in which said third post is removably fixed to said first side panel and said fourth post is removably fixed to said second side panel.

5. The background shield of claim 1 in which there is positioned in front of said back panel a sloping means reaching from the ground in front of said back panel to an area higher on said back panel whereby a soccer ball hitting said sloping means will be directed to hit the back panel in a higher region thereof than originally directed.

6. The background shield of claim 1 in which said bracing means is behind and attached to said back panel.

7. The background shield of claim 6 in which said bracing means is removably attached to said back panel.

8. The background shield of claim 4 in which said bracing means is removably attached to said back panel.

* * * * *